US009132668B2

(12) United States Patent
Maeda

(10) Patent No.: US 9,132,668 B2
(45) Date of Patent: Sep. 15, 2015

(54) PRINT CONTROL APPARATUS, PRINT CONTROL METHOD, AND PROGRAM

(71) Applicant: CANON KABUSHIKI KAISHA, Tokyo (JP)

(72) Inventor: Masao Maeda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/314,721

(22) Filed: Jun. 25, 2014

(65) Prior Publication Data

US 2015/0002565 A1 Jan. 1, 2015

(30) Foreign Application Priority Data

Jun. 28, 2013 (JP) ..... 2013-137040

(51) Int. Cl.

| | |
|---|---|
| ***B41J 29/38*** | (2006.01) |
| ***B41J 29/393*** | (2006.01) |
| ***B41J 2/01*** | (2006.01) |
| ***B41J 11/00*** | (2006.01) |

(52) U.S. Cl.
CPC ..... *B41J 11/008* (2013.01); *B41J 11/003* (2013.01)

(58) Field of Classification Search
USPC ..... 347/5, 14, 16, 19, 101
See application file for complete search history.

(56) References Cited

U.S. PATENT DOCUMENTS

| | | | | |
|---|---|---|---|---|
| 2004/0027420 | A1* | 2/2004 | Samii | 347/48 |
| 2006/0033792 | A1* | 2/2006 | Sano | 347/95 |

FOREIGN PATENT DOCUMENTS

| | | | |
|---|---|---|---|
| JP | 2006-215962 | A | 8/2006 |

* cited by examiner

*Primary Examiner* — Jason Uhlenhake
(74) *Attorney, Agent, or Firm* — Canon USA, Inc., I.P. Division

(57) ABSTRACT

An apparatus individually selects a width and a length corresponding a margin setting from among respective widths and lengths of a plurality of candidates of print medium which are obtained by a sensor detecting the size of the print medium. Then, the apparatus causes a print unit to print an image in a size corresponding to the selected width and length and the margin setting.

18 Claims, 9 Drawing Sheets

FIG.4A

| | | | |
|---|---|---|---|
| SHEET SIZE | SHEET WIDTH | SHEET LENGTH | ASPECT RATIO |
| L | 89.0 | 127.0 | 1.43 |
| SIDE-OPENING ENVELOPE NO. 6 | 98.0 | 190.0 | 1.94 |
| POSTCARD | 100.0 | 148.0 | 1.48 |
| 4 × 6 | 101.6 | 152.4 | 1.50 |
| END-OPENING ENVELOPE (LONG FORMAT) NO. 3 | 120.0 | 235.0 | 1.96 |
| 2L | 127.0 | 178.0 | 1.40 |
| RETURN POSTCARD | 200.0 | 148.0 | 0.74 |
| 6P | 203.2 | 254.0 | 1.25 |
| A4 | 210.0 | 297.0 | 1.41 |
| LETTER | 215.9 | 279.4 | 1.29 |
| 300 | 301 | 302 | 303 |

FIG.4B

| | | | | SHEET CLOSE IN SIZE | | | | | | | | | |
|---|---|---|---|---|---|---|---|---|---|---|---|---|---|
| SHEET SIZE | SHEET WIDTH | SHEET LENGTH | ASPECT RATIO | L | SIDE-OPENING ENVELOPE NO. 6 | POSTCARD | 4 × 6 | END-OPENING ENVELOPE (LONG FORMAT) NO. 3 | 2L | RETURN POSTCARD | 6P | A4 | LETTER |
| L | 89.0 | 127.0 | 1.43 | – | | | | | | | | | |
| SIDE-OPENING ENVELOPE NO. 6 | 98.0 | 190.0 | 1.94 | | – | × | × | | | | | | |
| POSTCARD | 100.0 | 148.0 | 1.48 | | × | – | × | | | | | | |
| 4 × 6 | 101.6 | 152.4 | 1.50 | | × | × | – | | | | | | |
| END-OPENING ENVELOPE (LONG FORMAT) NO. 3 | 120.0 | 235.0 | 1.96 | | | | | – | | | | | |
| 2L | 127.0 | 178.0 | 1.40 | | | | | | – | | | | |
| RETURN POSTCARD | 200.0 | 148.0 | 0.74 | | | | | | | – | × | × | × |
| 6P | 203.2 | 254.0 | 1.25 | | | | | | | × | – | × | × |
| A4 | 210.0 | 297.0 | 1.41 | | | | | | | × | × | – | × |
| LETTER | 215.9 | 279.4 | 1.29 | | | | | | | × | × | × | – |
| 300 | 301 | 302 | 303 | 304 | | | | | | | | | |

PRINT CONTROL APPARATUS, PRINT CONTROL METHOD, AND PROGRAM

BACKGROUND

1. Field of the Disclosure

Aspects of the present invention generally relate to a print control apparatus, a print control method, and a program for printing an image of a printing target.

2. Description of the Related Art

There is a technique, when printing is executed in a printing apparatus, for causing a sheet width sensor installed in the printing apparatus to detect a width of a sheet to be used in the printing apparatus and changing a magnification of an image of a printing target according to the sheet width detected by the sheet width sensor.

Japanese Patent Application Laid-Open No. 2006-215962 describes a technique for specifying a group of a sheet size from sheet widths detected by a sheet width sensor. Japanese Patent Application Laid-Open No. 2006-215962 also describes a technique for changing a magnification of a reference size in the group to conform to other sizes in the group according to whether margins are provided in a print medium in printing, and rasterizing an image of a printing target based on the changed reference size.

However, the techniques described in Japanese Patent Application Laid-Open No. 2006-215962 change the magnification of the reference size according to whether margins are provided in a print medium, thus an image sometimes cannot be printed in an appropriate size.

For example, if a group of the sheet size includes a size A which is vertically long in the aspect ratio and a size B which is horizontally longer than the size A in the aspect ratio, and the size A is a reference size of the group. In this case, if the reference size (i.e., size A) is enlarged to fit into the size B so as not to provide a print sheet with margins, an image vertically longer than the size A and the size B would be printed. If size B sheets are set in the printing apparatus, the vertically long image is printed on the size B sheet, which is horizontally long, therefore a printed image may be largely impaired.

SUMMARY

Aspects of the present invention relate to a print control apparatus, a print control method, and a program which can print an image in an appropriate size.

According to an aspect of the present invention, an apparatus comprises a determination unit configured to determine a margin setting for printing of an image of a printing target, a selection unit configured to individually select a width and a length corresponding to the margin setting determined by the determination unit from among respective widths and lengths of a plurality of candidates of print medium obtained by a sensor detecting the size of the print medium, and a print control unit configured to cause a print unit to print the image of the printing target in a size corresponding to the width and the length selected by the selection unit and the margin setting.

Further features of the present invention will become apparent from the following description of exemplary embodiments with reference to the attached drawings.

BRIEF DESCRIPTION OF THE DRAWINGS

FIGS. 4A and 4B are tables of sheet sizes according to an exemplary embodiment.

DESCRIPTION OF THE EMBODIMENTS

Various exemplary embodiments, features, and aspects of the invention will be described in detail below with reference to the drawings.

Figure 1:
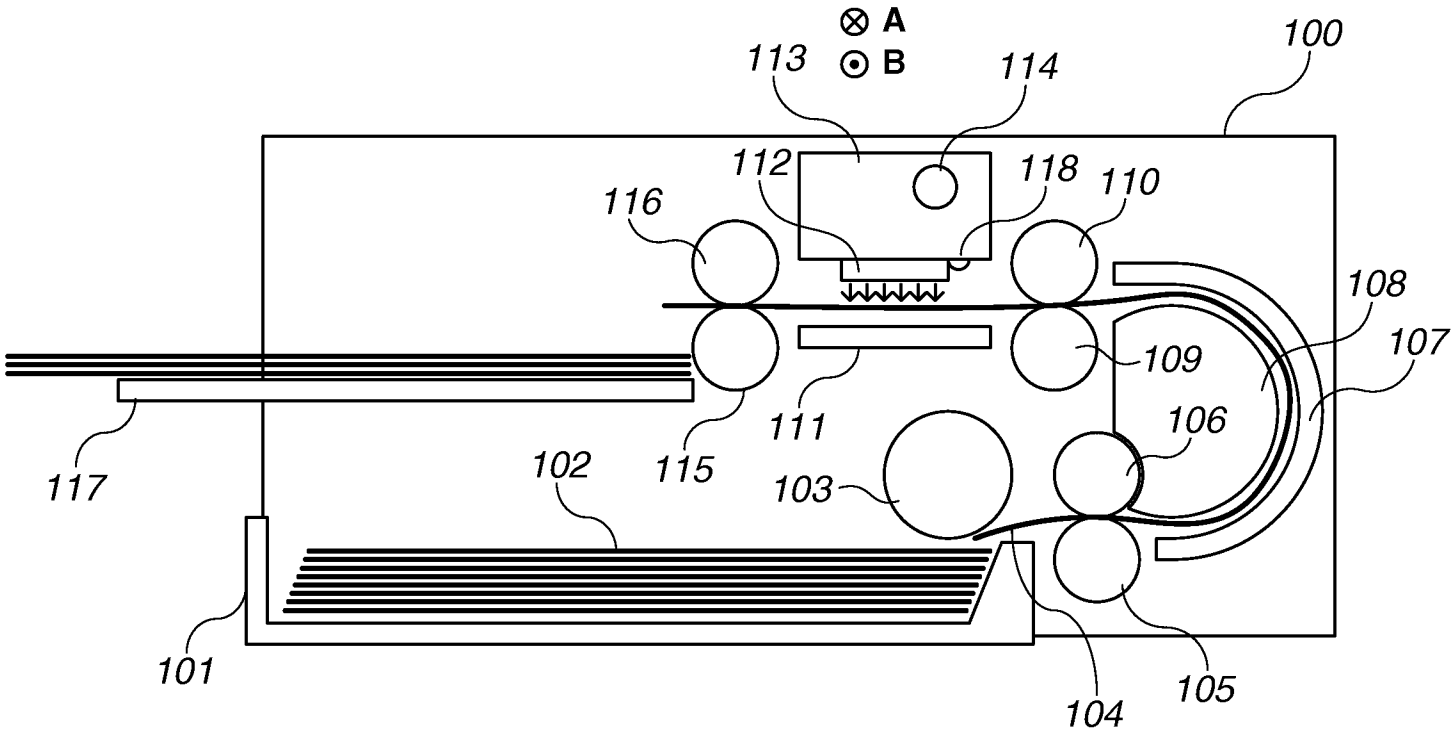
FIG. 1 illustrates a printing mechanism included in a printing apparatus 100.

FIG. 1 illustrates a printing mechanism included in a printing apparatus 100 according to the present exemplary embodiment. Print sheets are stored in a sheet feeding tray 101. A sheet feeding roller 103 feeds the print sheets stored in the sheet feeding tray 101 to conveyance rollers 105 and 106. A print sheet 104 is a print sheet fed by the sheet feeding roller 103 and conveyed by the conveyance rollers 105 and 106. As illustrated in FIG. 1, the print sheet 104 is conveyed by the conveyance rollers 105 and 106 through a conveyance path formed by members 107 and 108 to conveyance rollers 109 and 110. The conveyance rollers 109 and 110 convey the print sheet 104 to a platen 111.

A carriage 113 equipped with a print head 112 is provided above the platen 111. The carriage 113 reciprocates for scanning in a direction A (a direction from a front to a back in FIG. 1) and a direction B (a direction from the back to the front in FIG. 1) in FIG. 1 along a guide rail 114. The printing apparatus 100 applies a driving pulse to the print head 112 while moving the carriage 113 in the direction A and the direction B for scanning, and causes the print head 112 to eject a recording material such as ink. The print head 112 ejects the recording material to the print sheet 104 as thus described, and an image of a printing target is printed on the print sheet 104. The print sheet 104 on which the image is printed is further conveyed to discharge rollers 115 and 116 by the conveyance rollers 109 and 110. The discharge rollers 115 and 116 discharge the print sheet 104 to a discharge tray 117.

The carriage 113 is provided with the sheet sensor 118 which is a reflective optical sensor. The printing apparatus 100 obtains an output level (output voltage) indicating intensity of light received by the sheet sensor 118 and determines whether the output level corresponds to a level of reflected light from the print sheet, so that the printing apparatus 100 can detect whether the print sheet exists on a position at which the light received. As described above, the sheet sensor 118 is provided in the carriage 113 and is used for scanning together with the print head 112. In addition, the printing apparatus 100 detects whether the print sheet 104 exists in a range in which scanning is performed by the sheet sensor 118, and thus can determine an end portion of the print sheet in the scanning range. Further, a width of the print sheet can be detected based on a distance between right and left end portions of the print sheet. The detection processing is described in detail below with reference to FIG. 2. A scanning position of the sheet sensor 118 (the carriage 113) is detected by an encoder 224, which is described below.

The printing apparatus 100 includes the above described sheet feeding tray 101, platen 111, print head 112, carriage 113, guide rail 114, and discharge tray 117, and the above described various types of rollers as the printing mechanism.

Figure 2:
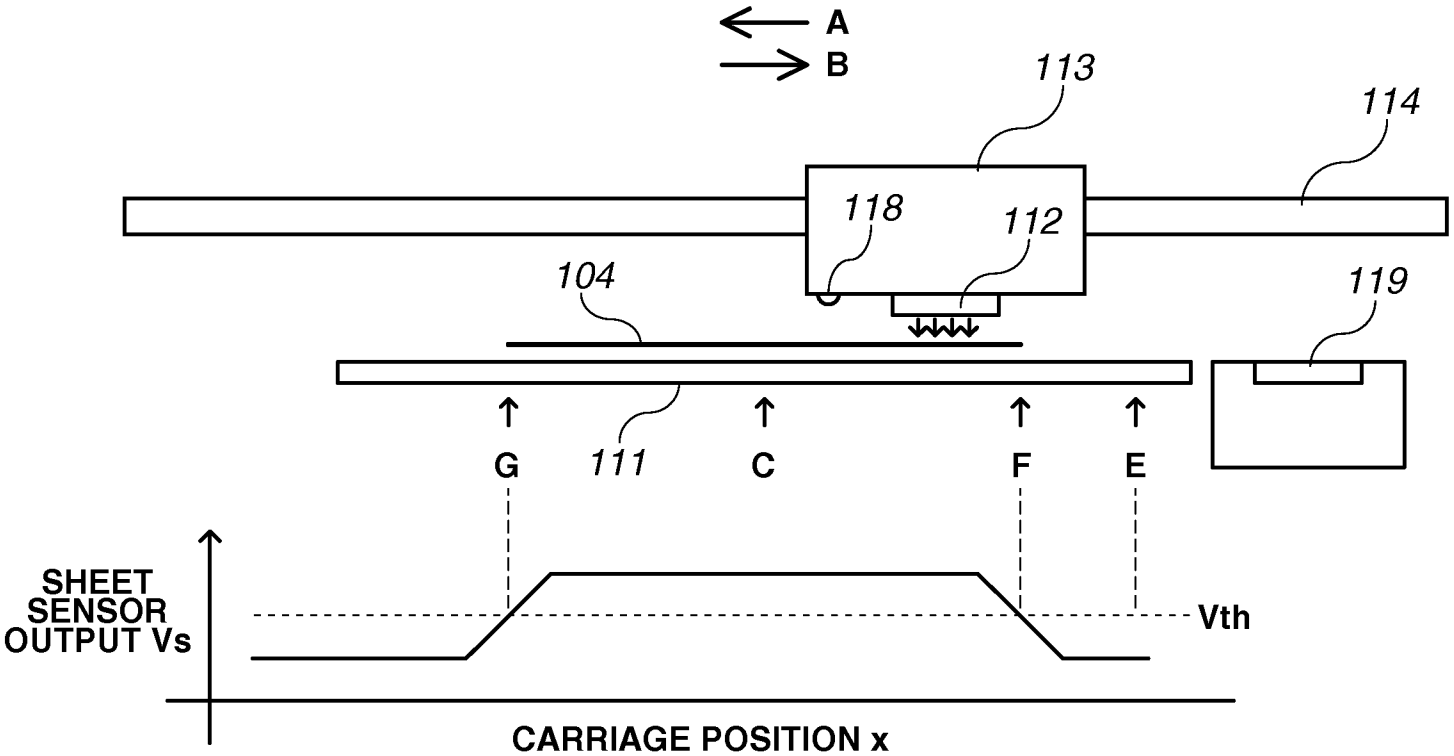
FIG. 2 illustrates how a sheet sensor 118 detects a sheet width.

FIG. 2 illustrates how the sheet sensor 118 detects a sheet width.

As described above, the printing apparatus 100 reciprocatively moves the carriage 113 in the direction A and the direction B shown by arrows along the guide rail 114 and causes the print head 112 to eject the recording material to print an image on the print sheet 104. In addition, a head recovery mechanism 119 for capping the print head 112 is provided at a position out of the platen 111 in a moving range of the carriage 113 (a position x of the sheet sensor). The position x of the sheet sensor can be determined by a position of the carriage 113 detected by the encoder 224 to be described below.

The sheet sensor 118 receives light while scanning on the platen 111 and detects an output level of the received light. A graph illustrated in FIG. 2 indicates output levels detected by the sheet sensor 118 in the moving range of the carriage 113. According to the present exemplary embodiment, a print sheet is a bright color, such as white, and the platen 111 is a dark color, such as black. Therefore, a high output level (intense reflected light from a print sheet) can be obtained at a position where the print sheet exists on the platen 111, and a low output level (weak reflected light from the platen 111) can be obtained at a position where the print sheet does not exist.

The sheet sensor 118 receives reflected light from a position E of the platen 111 when the carriage 113 is positioned at the head recovery mechanism 119. When the carriage 113 moves toward the direction A, the output level increases at a position corresponding to an end portion of the print sheet 104. Further, the output level is maintained at nearly constant to an opposite side end portion of the print sheet 104, and then decreases at the end portion.

According to the present exemplary embodiment, if an output level of the sheet sensor 118 exceeds a predetermined threshold value Vth, it is determined that the print sheet 104 exists at the position at which the output level was detected. More specifically, a position G and a position F in FIG. 2 are end positions of the print sheet 104, and a range from the position G to the position F is a range in which the print sheet 104 exists. In addition, a distance between the position G and the position F is detected as a sheet width of the print sheet 104.

According to the present exemplary embodiment, the printing apparatus 100 conveys the print sheet 104 in the center so as to fit the center of the print sheet into a center position C of the platen 111. However, if the print sheet 104 is large and a right end of the print sheet 104 is on the right than a position E in FIG. 2, a right end position of the print sheet 104 cannot be detected in some cases.

Therefore, according to the present exemplary embodiment, when the right end position of the print sheet 104 is on the right of the position E, the printing apparatus 100 determines the sheet width of the print sheet 104 based on a distance between the center position C and the position G which is a left end position of the print sheet 104. More specifically, first if an output level at the position E exceeds the threshold value Vth, it is determined that the right end position of the print sheet 104 is on the position E or on the right of the position E. If such determination is made, a length obtained by doubling the distance between the center position C and the position G is detected as the sheet width of the print sheet 104. In other words, the printing apparatus 100 conveys the print sheet 104 so that the center of the print sheet 104 matches the center position C, and thus the distance between the center position C and the position G, which is the left end position of the print sheet 104, becomes half the length of the sheet width. Therefore, the printing apparatus 100 can detect a length obtained by doubling the distance between the center position C and the position G as the sheet width. In this instance, a value indicating the center position C in a scanning range of the carriage is stored beforehand in a memory in the printing apparatus 100, and the printing apparatus 100 can calculate the distance between the center position C and the position G by referring to this value.

The above-described threshold value Vth does not need to be a fixed value, and the threshold value can be changed in response to, for example, an output level at the position E. Further, the threshold value Vth can be determined in response to intensity of reflected light according to a surface characteristic of a print medium. More specifically, the threshold value Vth is changed in response to a type of a sheet (plain paper, glossy paper, or the like) to be used in printing. Further, as a method for detecting presence or absence of a print sheet, the presence or absence of a print sheet can be detected based on a comparison result of an output level at the position E and an output level at another position instead of the method for determining whether an output level exceeds the threshold value as described above. For example, if it is determined that a print sheet does not exist on the position E based on the output level of the position E, it can be determined that a print sheet exists on a position at which an output level is more than a predetermined value as high as the output level of the position E.

The method illustrated in FIG. 2 is an example in which the carriage 113 is provided with the sheet sensor 118, and the sheet sensor 118 performs detection while moving, however, the configuration is not limited to this example. For example, a sheet sensor can be provided on the platen 111 separately from the carriage 113. In this case, sheet sensors are arrayed in amounts corresponding to a width of a conveyance path of a print sheet, and each of the sheet sensors determines whether presence of a print sheet is detected, so that a width of a print sheet can be determined.

Figure 3:
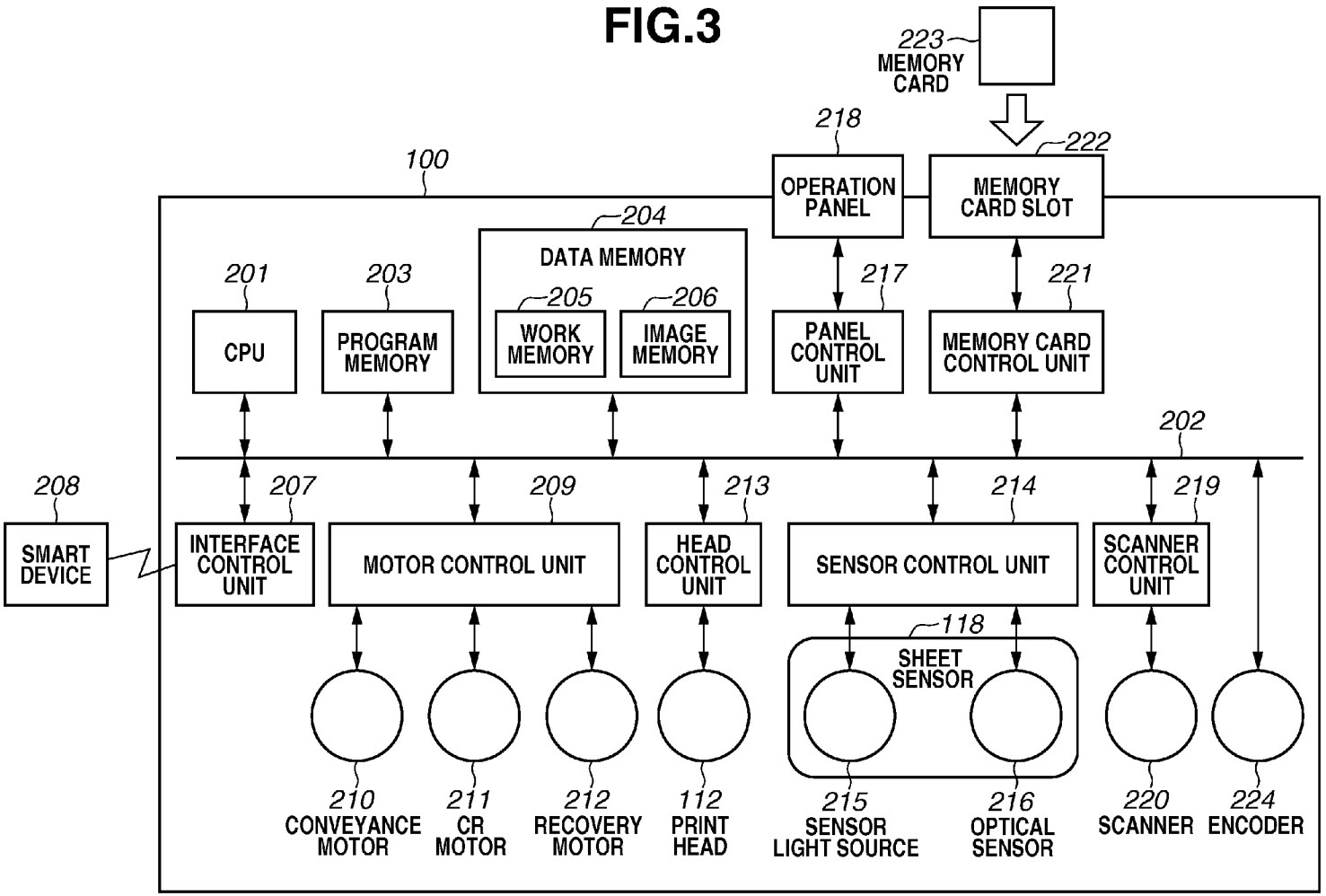
FIG. 3 is a block diagram illustrating a configuration of the printing apparatus 100.

Next, a configuration of the printing apparatus 100 is described below. FIG. 3 is a block diagram illustrating a configuration of the printing apparatus 100.

A CPU 201 is a processor for controlling the printing apparatus 100. The CPU 201 is connected to a program memory 203, such as a read only memory (ROM) and a hard disk, and a data memory 204, such as a random access memory (ROM), via an inner bus 202. The program memory 203 stores programs for controlling the printing apparatus 100 therein. The CPU 201 reads out a program stored in the program memory 203 to the data memory 204 and executes the program on a work memory 205 allocated to the data memory 204 to thus control the printing apparatus 100. In addition, an image memory 206 is allocated to the data memory 204, and various types of data like image data to be printed by the printing apparatus 100 is developed in the image memory 206 by the CPU 201.

An interface control unit 207 communicates with a smart device 208, such as a smartphone, via an interface by the control of the CPU 201. For example, the interface control unit 207 can receive a job of a printing target from the smart device 208, and notify the smart device 208 of status information of the printing apparatus 100. The interface control unit 207 can perform communication via a wired interface, such as a universal serial bus (USB) cable, or a wireless interface, such as an infrared communication and a wireless local area network (LAN). The smart device 208 includes, for example, a smartphone and a tablet terminal. Further, a mobile terminal like a mobile phone and a personal digital assistant (PDA) can be operated as the smart device 208 according to the present exemplary embodiment.

The interface control unit 207 can handle not only the smart device 208 but also a personal computer as a communication partner. Further, a server connected via a network, a facsimile device connected via a telephone line, and a device like a digital television can be a communication partner. Data of a printing target can be included in a print job, and also be obtained by the printing apparatus 100 from an external device, such as a server, according to address information included in the print job.

A motor control unit 209 controls various motors for driving the printing mechanism of the printing apparatus 100 by the control of the CPU 201. A conveyance motor 210 drives the sheet feeding roller 103, the conveyance rollers 105, 106, 109, and 110, and the discharge rollers 115 and 116, which are illustrated in FIG. 1, according to the control of the motor control unit 209. A carriage motor 211 (CR motor) drives and reciprocates the carriage 113 according to the control of the motor control unit 209. Further, a recovery motor 212 drives the head recovery mechanism 119 according to the control of the motor control unit 209.

A head control unit 213 controls the print head 112 to eject a recording material such as ink according to the control of the CPU 201. The CPU 201 drives the print head 112 and the conveyance motor 210 together to cause the print head 112 to print an image on a print sheet while performing scanning. In other words, the CPU 201 in the printing apparatus 100 operates as a print control apparatus and controls various motors and the print head 112 serving as the printing mechanism to print an image.

A sensor control unit 214 causes a sensor light source 215 included in the sheet sensor 118 to emit light and causes an optical sensor 216 included in the sheet sensor 118 to receive reflected light according to the control of the CPU 201. The sensor control unit 214 further obtains an output level indicating intensity of the light received by the optical sensor 216. The CPU 201 receives the output level obtained by the sensor control unit 214, and thus can determine a sheet width illustrated in FIG. 2. The CPU 201 determines a sheet size including a sheet length according to the sheet width determined as described above by processing to be described below.

A panel control unit 217 controls an operation panel 218 according to the control of the CPU 201. The operation panel 218 includes an operation device, such as keys and a panel, on which a user makes an operation, and a display panel capable of displaying various pieces of information, such as images. For example, when a user operates the operation device of the operation panel 218, an instruction made by the user is input to the panel control unit 217 and further input to the CPU 201. In addition, the panel control unit 217 displays an image developed on the image memory 206 to the display panel of the operation panel 218 according to an instruction from the CPU 201.

A scanner control unit 219 controls a scanner 220 to read a document placed on a document plate of the scanner 220 and inputs the read image according to the control of the CPU 201. Further, the scanner control unit 219 stores the read image in the image memory 206. A memory card control unit 221 performs writing and reading of various types of data on a memory card 223 loaded into a memory card slot 222 according to the control of the CPU 201.

The encoder 224 determines a position of the carriage 113 when the carriage 113 performs scanning along the guide rail 114. The CPU 201 determines a position x of the sheet sensor illustrated in FIG. 2 based on the position of the carriage 113 determined by the encoder 224 and a mounting position of the sheet sensor 118 to the carriage 113.

According to the present exemplary embodiment, the CPU 201 determines a sheet size including a sheet length according to the sheet width determined by the sheet sensor 118 as described above. Further, in the printing apparatus 100 according to the present exemplary embodiment, the sheet sensor 118 is mounted to the carriage 113 together with the print head 112. The members including various motors and the guide rail 114 for moving the carriage 113, and the encoder 224 for determining the position of the carriage 113 can be commonly used for both of printing performed by the print head 112 and detection of a sheet width by the sheet sensor 118. Therefore, the above-described members are not necessary to be provided for detecting a sheet width separately from members for printing, thus the printing apparatus 100 can be prevented from enlarging.

FIGS. 4A and 4B are tables of sheet sizes according to the present exemplary embodiment. A sheet size management table illustrated in FIG. 4A includes a sheet size 300 and a sheet width 301, a sheet length 302, and an aspect ratio 303 of the sheet size 300, which can be used in the printing apparatus 100. A unit of the sheet width 301 and the sheet length 302 is millimeter (mm).

The sheet size tables are stored in the program memory 203, and the CPU 201 reads out the sheet size table from the program memory 203 to the data memory 204 to refer the sheet size table. However, it is not limited to a table format for storing information about the sheet width 301. Various methods can be employed for storing the sheet width 301 in association with the sheet size.

According to the present exemplary embodiment, the CPU 201 determines a print sheet size according to a sheet width detected by the sheet sensor 118. More specifically, the CPU 201 specifies the sheet size 300 having the sheet width 301 which is within a predetermined range of a sheet width detected by the sheet sensor 118 in the sheet size table as a size of a print sheet 104 being conveyed in the printing apparatus 100. Such a predetermined range is set because there may be an error between a detection result of the sheet sensor 118 and an actual sheet width since intensity of reflected light from a print sheet varies according to, for example, a state of the print sheet and an environment in which the printing apparatus 100 is installed.

Therefore, for example, if the predetermined range is set to 3 mm each on top and bottom and the sheet sensor 118 detects a sheet width as 126.0 mm, the sheet size 300 corresponding to the sheet width 301 included within 123.0 mm to 129.0 mm is specified as a candidate of a print sheet size. As shown in the sheet size table in FIG. 4A, in this case, a "2L" size corresponding to the sheet width 301 (127.0 mm) is specified as a candidate.

The sheet size is not always uniquely specified as above. There is a case that a plurality of sheet sizes close to the sheet width is specified as a candidate for the size of the print medium. For example, if the sheet sensor 118 detects a sheet width as 99.0 mm, a side-opening envelope No. 6 (sheet width 98.0 mm), a postcard (sheet width 100.0 mm), and a "4*6" size (sheet width 101.6 mm) are included in a range 96.0 mm to 102.0 mm of the sheet width. Similarly, if a sheet width is detected as 213.0 mm, an A4 size (sheet width 210.0 mm) and a letter size (sheet width 215.9 mm) are specified as candidates of the sheet size.

According to the present exemplary embodiment, if a plurality of candidates is specified as a size of print sheets to be used in printing, a print sheet size is determined according to a margin setting when printing is executed. Then, an image size of a printing target is determined according to the print sheet size and the margin setting.

More specifically, a setting for "borderless printing" in which an image of a printing target is magnified larger than a sheet size and printed so as not to provide a margin on a print sheet is described below as an example of the margin setting. When the borderless printing is executed, a maximum sheet width in the plurality of candidates is selected as a sheet width of a sheet size, and a maximum sheet length in the plurality of candidates is selected as a sheet length of the sheet size. For example, if the A4 size (sheet width 210.0 mm, sheet length 297.0 mm) and the letter size (sheet width 215.9 mm, sheet length 279.4 mm) are candidates, a sheet size having a sheet width 215.9 mm and a sheet length 297.0 mm is determined as a print sheet size. Then, an image of a printing target is magnified so as to be larger than the print sheet size.

When the image of the printing target is magnified as thus described, even the size of the print sheets set in the printing apparatus 100 is the A4 size or the letter size, an image larger than the print sheet can be printed. Therefore, a print result can be prevented from including a margin. Details are described below with reference to FIGS. 6A and 6B, and FIG. 7.

As described above with reference to FIG. 2, according to the present exemplary embodiment, if the print sheet 104 is large, an end portion of the print sheet 104 cannot be detected by the sheet sensor 118 in some cases, and a sheet width is determined by calculation based on the distance between the center position C and the position G. In this case, the sheet may be conveyed in a state that the center of the print sheet 104 is deviated from the center position C due to, for example, characteristics of the print sheet 104. Therefore, when the end portion of the print sheet 104 is not detected, the above-described predetermined range can be set relatively wider, such as ±10 mm, instead of ±3 mm. In this case, if a sheet width is detected as 210 mm, a return postcard (sheet width 200.0 mm), a 6P size (sheet width 203.2 mm), the A4 size (sheet width 210.0 mm), and the letter size (sheet width 215.9 mm) are specified as candidates of the sheet size.

Further, in the above example, the sheet size is specified from the ones included in the predetermined range (e.g., ±3 mm) centering on the sheet width of the detection result of the sheet sensor 118. However, not limited to the above example, a sheet size may be specified from the ones included in a range which is predetermined width (e.g. +3 mm) larger than the detection result, or may be specified from the ones included in a range which is predetermined width (e.g. −3 mm) smaller than the detection result. Further, the above-described predetermined range may be changed according to a type of a print sheet (plain paper, glossy paper, or the like). For example, if a print sheet is glossy paper, reflected light therefrom is stronger than plain paper. In this case, an output level obtained by the sheet sensor 118 at a position which is originally not a position of the print sheet may exceed the above-described threshold value Vth, and the printing apparatus 100 is likely to determine that the print sheet exist at the position. Therefore, if the type of the print sheet is the plain paper, a range of ±3 mm may be set, and if the type of the print sheet is the glossy paper, a range of −6 mm may be set, for example. Alternatively, the above-described predetermined range may be set according to various conditions such as characteristics of the sheet sensor 118.

In the above description, a sheet size is determined using the sheet size table indicated in FIG. 4A. However, the sheet size may be determined using a sheet size table indicated in FIG. 4B as another example.

The sheet size table in FIG. 4B includes sheet information 304 indicating sheets close in a sheet width in addition to the sheet size table in FIG. 4A. More specifically, a sheet size having a cross mark (x) in the table is close in a sheet width to a sheet size corresponding thereto in the table. For example, the A4 size and the letter size are specified as sheets whose sheet width are close to each other in the sheet size table. Further, the side-opening envelope No. 6, the postcard, and the "4*6" size are specified as sheets whose sheet width are close to each other.

The CPU 201 reads out the sheet size table in FIG. 4B from the program memory 203 to the data memory 204 to refer the sheet width 301. Further, when the sheet sensor 118 detects a sheet width, the CPU 201 specifies a sheet size corresponding to the detected sheet width. Then, if a sheet size close in the sheet width to the relevant sheet size is specified in the sheet size table, the CPU 201 specifies a plurality of candidates of the sheet size including the sheet size close in the sheet width.

For example, if the sheet sensor 118 detects a sheet width as 90.0 mm, an "L" size is uniquely specified as a sheet size. Whereas if the sheet sensor 118 detects a sheet width as 99.0 mm, the postcard size is specified as a sheet size which is the closest to the detected sheet width, and in addition to the postcard, the side-opening envelope No. 6 and the "4*6" size specified in the sheet information 304 can be specified as the sheet side.

As described above, the CPU 201 determines a sheet size of a print sheet including the sheet length 302 in addition to the sheet width 301 based on the sheet size table in FIG. 4A or in FIG. 4B. Then, the CPU 201 executes print processing corresponding to the determined sheet size.

The CPU 201 can set an arbitrary sheet size as a sheet size to perform printing in addition to the sheet sizes (i.e., regular sizes) indicated in FIGS. 4A and 4B. More specifically, the CPU 201 can set a sheet width and a sheet length by the millimeter (mm) as the sheet size, change a magnification of an image of a printing target according to the set sheet width and sheet length, and print the image in a size corresponding to the set sheet size on a print sheet.

Figure 5:
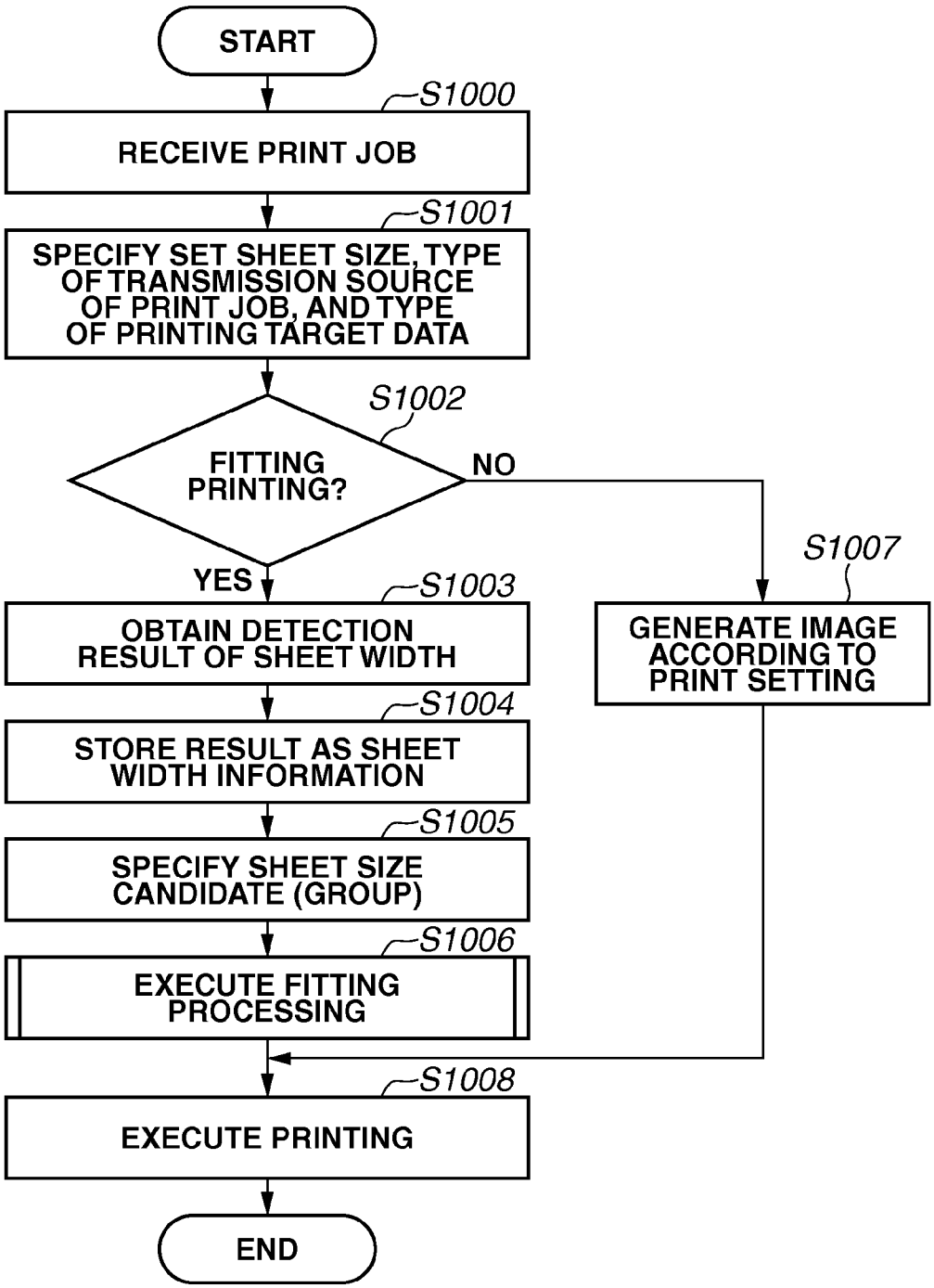
FIG. 5 is a flowchart illustrating an example of print control processing executed by a central processing unit (CPU) 201.

FIG. 5 is a flowchart illustrating an example of the print control processing executed by the CPU 201. A program corresponding to processing in the flowchart illustrated in FIG. 5 is stored in the program memory 203. The CPU 201 reads out the program to the work memory 205 and executes it on the work memory 205, and thus the processing in each step in the flowchart illustrated in FIG. 5 can be realized.

In step S1000, the CPU 201 receives a print job from an external apparatus via the interface control unit 207 and stores the print job in the data memory 204. The print job includes data, such as an image which is a printing target of the printing apparatus 100, and print setting information indicating print settings, such as a type of a sheet used in the printing of the relevant data.

When a print job is received in step S1000, then in step S1001, the CPU 201 specifies a sheet size set in the print setting, a type of the apparatus which transmitted the print job, and a data type of the printing target included in the print job.

In step S1001, the CPU 201 analyzes the print setting information included in the print job received in step S1000. Then, the CPU 201 specifies a set size of a print sheet (set sheet size) which is set with respect to the data of the printing target corresponding to the print job in the print setting information. The set sheet size in the print setting information is set by the apparatus (a server, a host computer, a smart device, or the like) which transmitted the print job received by the CPU 201 in step S1000. For example, when a user of the relevant apparatus specifies the print sheet size on a screen thereof, size information indicating the specified size is registered in the print setting information as the set sheet size, and the print job including the print setting information is received in S1001. In step S1001, the print sheet size set as thus described is specified.

The above-described print setting information is included in the print job as information different from the data of the printing target. In other words, information indicating the set sheet size is also included in the print job separately from the data of the printing target. In addition, the print setting information including the set sheet size can be transmitted as one file to the printing apparatus 100 like a digital print order format (DPOF) file. In other words, the print setting information can be transmitted to the printing apparatus 100 as a different file from the data (e.g. a joint photographic experts group (JPEG) file) of the printing target.

However, the setting information of the print sheet size is sometimes included in the print setting information and sometimes not depending on the apparatus which transmitted the print job received in step S1000 and an application issuing a print instruction in the print job. In step S1001, when the setting information of the print sheet size is included, the size indicated by the setting information is specified as the set sheet size.

Further, in the case where the type of the apparatus is determined, for example, the type may be determined by a protocol used in the communication when the print job is received from the external apparatus or by receiving information indicating the type of the external apparatus from the external apparatus. The data type of the printing target may be determined by checking an extension of a file of the printing target. Further, the printing apparatus 100 can receive information indicating the data type of the printing target from the apparatus which transmitted the print job and determine the data type based on the received information.

In step S1002, the CPU 201 determines whether to execute fitting printing according to the type of the apparatus and the data type of the printing target specified in step S1001. The fitting printing is to perform printing by adjusting a size of the image of the printing target to the size of the print sheet stored in the printing apparatus 100. More specifically, the CPU 201 determines whether each of the type of the apparatus and the data type specified in step S1001 is a predetermined type, and when they are the predetermined types respectively, the CPU 201 determines to perform the fitting printing. For example, if the printing apparatus 100 can receive a print job from the server, the host computer, or the smart device 208, the printing apparatus 100 executes the fitting printing by regarding the smart device 208 as an apparatus of the predetermined type. Further, the CPU 201 checks a file format of the data of the printing target to determine whether the file format is a predetermined file format. Regarding the above-described predetermined types, for example, apparatus types and file formats from which a photograph is likely to be chosen as a printing target can be set as the above-described predetermined types, so that the fitting printing can be surely executed with respect to photographs.

File formats which can be printed by the printing apparatus 100 include a JPEG format, a predetermined raster file format, and a portable document format (PDF). Further, the above-described predetermined type of the file format includes, for example, the JPEG format and the predetermined raster format. In step S1002, if the file format specified in step S1001 is the predetermined file format (YES in step S1002), the CPU 201 determines to execute the fitting printing. Whereas if the file format specified in step S1001 is PDF (NO in step S1002), the CPU 201 determines not to execute the fitting printing.

In step S1002, whether to execute the fitting printing or not is determined based on both of the apparatus type and the data type of the printing target, however, determination can be made based on either type. For example, the JPEG format is sometimes used as a file format for storing an image captured by an image capturing device in a memory. Thus, in step S1002, if data of the printing target is in the JPEG format, the CPU 201 can determine to execute the fitting printing.

In addition, various types of information can be specified in step S1001 and be a determination condition in step S1002. For example, if a print mode of the printing apparatus 100 is a mode for executing the fitting printing, the fitting printing may be executed. Further, if a protocol used in step S1001 to receive a print job from the external apparatus, such as the smart device 208, is a predetermined protocol, the CPU 201 can determine to execute the fitting printing. Furthermore, if the printing apparatus 100 includes a plurality of interfaces, the CPU 201 can determine to execute the fitting printing according to the interface used to receive the print job in step S1001. If "direct (same size) printing" is specified in the print setting information, the fitting printing may not be executed.

For another condition, when the sheet size is not specified in the print setting information included in the print job received in step S1001, the fitting printing may be executed. Examples of the case that the sheet size is not specified may be a case where information indicating the sheet size is not included in the print setting information and a case where information instructing the fitting printing is included in the print setting information as information of the sheet size.

For yet another condition, whether to execute the fitting printing may be determined according to whether a user input an instruction to execute the fitting printing on a screen by the detection of the sheet width by the sheet sensor 118. For example, the CPU 201 of the printing apparatus 100 causes the operation panel 218 to display a screen including a check box for inputting the above-described instruction and the fitting printing is executed if a user inputs a check in the check box. In addition, the above-described screen may be displayed in the external apparatus which transmits print job data to the printing apparatus 100, and a user may instruct execution of the fitting printing at the external apparatus. In this case, the external apparatus involves information for executing the fitting printing in the print job data (or adds the information to the print job data) to transmit the print job data to the printing apparatus 100. The CPU 201 of the printing apparatus 100 determines in step S1002 whether to execute the fitting printing according to whether the above-described information is received from the external apparatus. The above-described screen displayed in operation panel 218 or the external apparatus is displayed in advance before printing, and contents instructed by a user before the printing are confirmed when printing is executed in step S1002, so that whether to execute the fitting printing is determined. In addition, the above-displayed screen may be displayed when printing is executed and a user may issue an instruction at the time of printing.

Further, if a user does not issue the above-described instruction to execute the fitting printing, the CPU 201 may determine not to execute the fitting printing in step S1002 regardless of the type of the apparatus and the data type of the printing target specified in step S1001. In other words, the fitting printing may be determined to be executed when a user issues the above-described instruction and the type of the apparatus and the data type of the printing target are the predetermined types, respectively.

In step S1002, if the fitting printing is determined to be executed (YES in step S1002), the processing described in step S1003 to step S1006 is executed. Whereas, if the fitting printing is not determined to be executed (NO in step S1002), the processing proceeds to step S1007.

In step S1003, the CPU 201 drives the carriage 113 and the sheet sensor 118 by the motor control unit 209 and the sensor control unit 214 to perform sheet width detection which is described with reference to FIG. 2. Then, in step S1004, the CPU 201 obtains the sheet width detected by the sheet width detection in step S1003 and stores the sheet width in the work memory 205 as sheet width information.

Then, in step S1005, the CPU 201 specifies one or a plurality of sheet sizes as candidates of a size of a print medium from sizes of regular size sheets supported by the printing apparatus 100 with reference to the sheet width information stored in step S1004 and the sheet size tables in FIGS. 4A and 4B. As described above, a plurality of sheet sizes is extracted as the candidates of the size of the print medium depending on the sheet width information stored in step S1004. The extracted sheet size (group) is stored in the work memory 205 as sheet size candidate information.

Then, in step S1006, the CPU 201 executes fitting processing for generating an image of the printing target on the image memory 206 to match the size of the print medium being conveyed in the printing apparatus 100. The fitting processing is described in detail below with reference to FIG. 6.

In step S1002, if it is not determined that the fitting printing is executed (NO in step S1002), the processing in step S1007 is executed. In step S1007, the CPU 201 generates an image of the printing target on the image memory 206 according to the print setting specified by the print setting information. For example, when the print job includes data of an image of the printing target, and "enlargement/reduction printing" and "A4 size" are respectively set as a printing method and a print sheet size in the print setting, the CPU 201 develops the image data and changes the magnification of the developed image so as to fit into the A4 size. Further, when "direct printing" is specified as the printing method, an image of the printing target is generated without performing the magnification/reduction processing. When borderless printing is specified, an image of the printing target is laid out in a layout area obtained by enlarging the print sheet size set in the print setting at an enlargement rate for borderless printing.

For example, if the file format specified in step S1001 is PDF, it is determined that the fitting printing is not executed in step S1002. In this case, the sheet size may be set according to a page size set in the PDF file in step S1007.

In a PDF file, page size information can be written into the file and, for example, a page size suitable for a page in the PDF file is written in the file. If fitting of a page is performed on a size other than the page size, printing may be performed on a print sheet in a size different from the size of the print sheet which should be normally used in printing. Therefore, if the file format specified in step S1001 is PDF, the fitting printing is not executed, and the page size in the PDF file is set as the print sheet size in step S1007.

Further, if the printing target is a PDF file, in step S1007, sheet width detection may be executed by the sheet sensor 118. In this case, a width of the page size in the PDF file is compared with the sheet width detected by the sheet sensor 118. Then, when a difference between both widths is smaller than a predetermined width, printing is executed in accordance with the page size, and when the difference is equal to or larger than the predetermined width, an error message for allowing a user to confirm the print sheet size may be displayed on the operation panel 218.

In step S1008, the CPU 201 outputs the image of the printing target generated on the image memory 206 in step S1006 or in step S1007 to the head control unit 213. Then, the CPU 201 drives the print head 112 and the carriage 113 to print the image of the printing target on the print medium.

When the image of the printing target is generated in the above-described step S1006 or step S1007, if the data of the printing target is image data of a JPEG image file or the like, the CPU 201 performs decompression processing to develop bitmap data on the image memory 206. Further, if the data of the printing target is vector data, the CPU 201 performs rendering processing in the image memory 206 to develop bitmap data on the image memory 206.

According to the processing indicated in the flowchart in FIG. 5, an image in a size based on the print setting or the detection result of the sheet sensor 118 is printed by the printing apparatus 100.

According to the present exemplary embodiment, when a plurality of candidates of the sheet size is specified in step S1005 in FIG. 5, the sheet size is determined based on the margin setting of the printing, and an image of the printing target is magnified or reduced in response to the sheet size. Further, in the present exemplary embodiment, the margin setting is described below using a setting of "borderless printing" as an example. Then, the sheet size is determined according to whether execution of "borderless printing" is set as the margin setting.

Figure 6A:
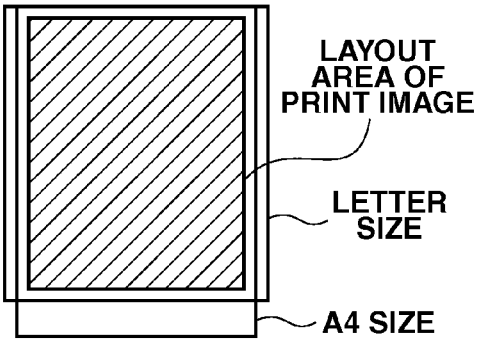
FIGS. 6A and 6B illustrate processing for determining an image size of a printing target according to the exemplary embodiment.
Figure 6B:
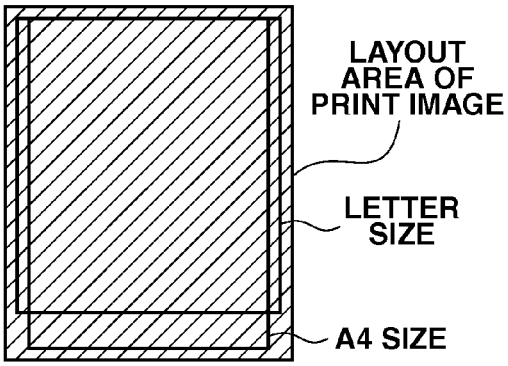

FIGS. 6A and 6B illustrate processing for determining an image size of a printing target according to the present exemplary embodiment, and they are examples when an A4 size and a letter size are specified as candidates of the sheet size. As shown in FIGS. 6A and 6B, when comparing the A4 size and the letter size, the letter size is longer in the sheet width, and the A4 size is longer in the sheet length. For example, when the borderless printing is not executed, it is appropriate that an entire image of the printing target is printed on a print sheet. Thus, according to the present exemplary embodiment, an area smaller than the plurality of candidates (i.e., the A4 size and the letter size) is set as a rendering area of the image of the printing target like a shaded area in FIG. 6A, and the image of the printing target is magnified or reduced according to the rendering area.

More specifically, a minimum sheet width and a minimum sheet length of the A4 size and the letter size are set as the sheet size, and a size of the image is changed to a size which is obtained by subtracting the margin respectively from the minimum sheet width and the minimum sheet length. For example, in FIG. 6A, when the A4 size (sheet width 210.0 mm, sheet length 297.0 mm) and the letter size (sheet width 215.9 mm, sheet length 279.4 mm) are the candidates, the sheet width 210.0 mm and the sheet length 279.4 mm are selected. Further, an area which is obtained by subtracting the margin in the sheet size respectively from the selected sheet width and sheet length is set as a rendering area of the image of the printing target, and the image is magnified or reduced according to the size of the set rendering area.

Since the image of the printing target is thus magnified or reduced as above, the printing apparatus 100 can print the entire image of the printing target on the print sheet even if the print sheet size to be used in the printing is the A4 size or the letter size.

On the other hand, when the borderless printing is executed, it is appropriate that the printing is executed without including the margins in the print sheet. Thus, according to the present exemplary embodiment, an area larger than the plurality of candidates is set as a rendering area of the image of the printing target like a shaded area in FIG. 6B, and the image of the printing target is magnified or reduced according to the rendering area.

More specifically, an area with the maximum sheet width and the maximum sheet length of the plurality of candidates (i.e., the sheet width 215.9 mm of the letter size and the sheet length 297.0 mm of the A4 size) is set as the rendering area. Further, an area which is obtained by enlarging the set rendering area at the predetermined enlargement rate for borderless printing (e.g. 105%) is set as a rendering area of the image of the printing target, and the image is magnified or reduced according to the size of the set rendering area.

Since the image of the printing target is thus magnified or reduced as above, the printing apparatus 100 can perform printing without including the margins in the print sheet even if the print sheet size to be used in the printing is the A4 size or the letter size.

As described above, according to the present exemplary embodiment, when a plurality of candidates of the sheet size is specified by the detection result of the sheet sensor 118, a sheet width and a sheet length corresponding to the margin setting are separately selected from widths and lengths of the plurality of candidates. However, instead of separately selecting the width and the length of the print sheet as the above example, the rendering area of the image of the printing target can be determined by, for example, selecting any candidate from the plurality of candidates and changing the size of the selected candidate. For example, in the case of printing with borders, the selected candidate (e.g. the A4 size) is reduced so as to fit into the length of the letter size. In this case, however, the A4 size is vertically longer than the letter size, and when comparing with the example according to the present exemplary embodiment in FIG. 6A, the right and left margins may be unnecessarily broad. In contrast, in the case of the borderless printing, the selected candidate (e.g. the A4 size) is enlarged so as to be wider than the width of the letter size. In this case, the A4 size is vertically longer than the letter size, and when comparing with the example illustrated in FIG. 6B, image protruding amounts on the top and bottom may be unnecessarily broad.

According to the present exemplary embodiment, a sheet width and a sheet length corresponding to the margin setting are separately selected from the widths and lengths of the plurality of candidates of the sheet size. For example, the minimum width and the minimum length are separately selected in the printing with borders, and the maximum width and the maximum length are separately selected in the borderless printing. Accordingly, the printing with borders can be prevent from including unnecessary margins, and the borderless printing can be prevented from providing unnecessary image protruding amount.

Figure 7:
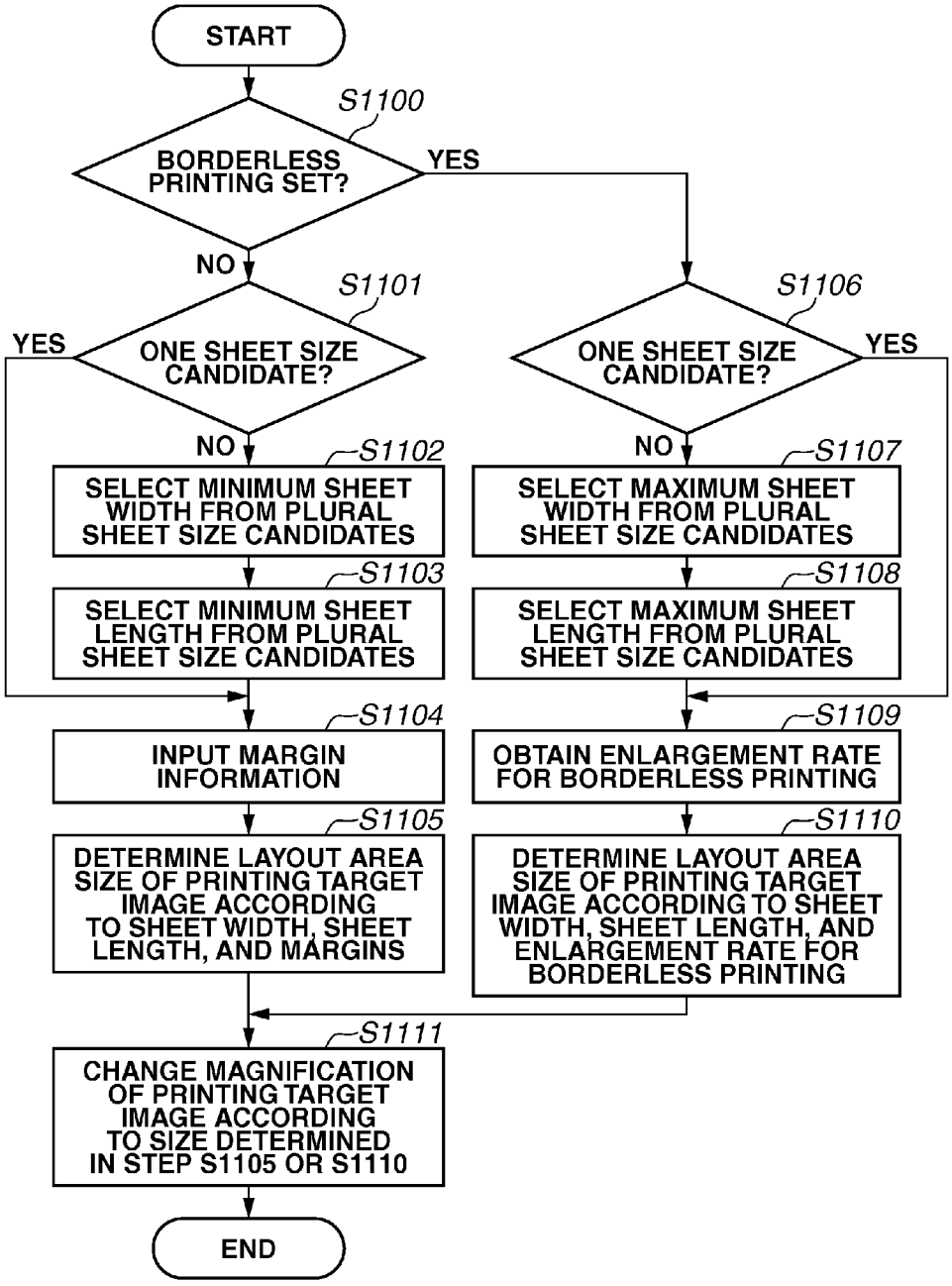
FIG. 7 is a flowchart illustrating details of fitting processing.

Details of the processing for determining an image size of a printing target described in FIGS. 6A and 6B are described below with reference to FIG. 7. FIG. 7 is a flowchart illustrating details of the fitting processing in step S1006 in FIG. 5.

In step S1100, the CPU 201 determines whether the borderless printing is set as the margin setting in the printing. The various conditions can be used for determining whether the borderless printing is set. For example, when the print mode of the printing apparatus 100 is a mode for performing the borderless printing, it can be determined that the borderless printing is set. In addition, the margin setting is input from the print setting information included in the print job received in step S1001 in FIG. 5, and it can be determined that the borderless printing is set when the borderless printing is specified in the margin setting. Further, information for specifying the apparatus which transmitted the print job or the application used for issuing the print instruction can be received together with the print job in step S1001 in FIG. 5. In this case, whether the borderless printing is set can be determined according to the type of the apparatus or the application specified by the received information. Whether the borderless printing is set can be also determined according to the size or the type of the print sheet to be used in the printing. For example, when the print sheet size is the "L" size or the "2L" size, or when the type of the print sheet is the "glossy paper", in other words when a print sheet which is often used for printing a photograph as an image of the printing target, is set as the print setting, it can be determined that the borderless printing is set.

In step S1100, if it is not determined that the borderless printing is set as the margin setting in the printing (NO in step S1100), the processing proceeds to step S1101. In step S1101, the CPU 201 determines whether the candidate of the print sheet size specified in step S1005 in FIG. 5 is one candidate. If it is determined that there is one candidate (YES in step S1101), the processing proceeds to step S1104, whereas if it is determined that there is a plurality of candidates (NO in step S1101), the processing proceeds to step S1102. Details of the processing in step S1104 are described below.

In step S1102, the CPU 201 selects a minimum sheet width from the sheet widths of the plurality of candidates of the sheet size specified in step S1005 in FIG. 5. More specifically, the CPU 201 refers to the sheet size tables illustrated in FIGS. 4A and 4B, obtains the sheet widths of the plurality of the candidates, and specifies the minimum one from the sheet widths. Then, the CPU 201 stores in the work memory 205 a value of the minimum sheet width as a width of the rendering area in which the image of the printing target is rendered.

Next, in step S1103, the CPU 201 selects a minimum sheet length from the sheet lengths of the plurality of candidates of the print sheet size. Details of the setting processing of the sheet length in step S1103 are similar to the setting processing in step S1102.

When the sheet width and the sheet length are set in the work memory 205 as described above by the processing in step S1102 and step S1103, the processing proceeds to step S1104.

In step S1104, the CPU 201 inputs the margin setting indicating a width of the margin on the print sheet when the borderless printing setting is not executed. The margin setting may be input from the print setting information included in the print job received in step S1001 FIG. 5, for example. Alternatively, the margin setting indicating a predetermined margin width in the printing apparatus 100 may be input from the program memory 203.

In step S1105, the CPU 201 determines a size of a layout area in which the image of the printing target is laid out according to the sheet width and the sheet length set by the processing in step S1102 and step S1103 and the width of the margin set in the margin setting input in step S1104. In other words, the sheet size is set in step S1102 and step S1103, and the width of the margin is specified, then a size obtained by subtracting the margin from the sheet size is determined as the size of the layout area.

On the other hand, in step S1100, if it is determined that the borderless printing is set as the margin setting in the printing (YES in step S1100), the processing proceeds to step S1106. In step S1106, the CPU 201 determines whether the candidate of the print sheet size specified in step S1005 in FIG. 5 is one candidate. If it is determined that there is one candidate (YES in step S1106), the processing proceeds to step S1109, whereas if it is determined that there is a plurality of candidates (NO in step S1106), the processing proceeds to step S1107.

In step S1107, the CPU 201 selects a maximum sheet width from the sheet widths of the plurality of candidates of the print sheet size. Then, in step S1108, the CPU 201 selects a maximum sheet length from the sheet lengths of the plurality of candidates of the print sheet size. Details of the setting processing in step S1106 and step S1107 are similar to the setting processing in step S1102 and step S1103.

When the sheet width and the sheet length are set in the work memory 205 as described above by the processing in step S1107 and step S1108, the processing proceeds to step S1109.

In step S1109, the CPU 201 obtains the enlargement rate for the borderless printing. When executing the borderless printing, the printing apparatus 100 prints an image larger than the print sheet so as not to generate blank spaces on edges of the print sheet. Thus, in step S1109, the CPU 201 obtains the enlargement rate for the borderless printing which indicates a ratio of the image size of the printing target to the print sheet size. According to the present exemplary embodiment, information indicating the enlargement rate for the borderless printing is stored in the program memory 203, and the CPU 201 obtains this information. Further, according to the present exemplary embodiment, the enlargement rate for the borderless printing is 105%.

In step S1110, the CPU 201 determines the image size of the printing target according to the sheet size (i.e., the sheet width and the sheet length) set in step S1107 and step S1108 and the enlargement rate for the borderless printing obtained in step S1109. More specifically, the CPU 201 determines a size obtained by multiplying the sheet size set in step S1107 and step S1108 by the enlargement rate for the borderless printing (105%) as a size of the layout area in which the image of the printing target is laid out (rendered).

When the image size of the printing target is determined in step S1105 or step S1110, the processing proceeds to step S1111. In step S1111, the CPU 201 renders the image of the printing target corresponding to the data included in the print job received in step S1001 in FIG. 5 to fit into the size of the layout area determined in step S1105 or step S1110. Accordingly, the image of the printing target is generated on the image memory 206 in the size according to the layout area determined in step S1105 or step S1110.

Further, in step S1111, the image of the printing target is magnified or reduced according to the margin setting. More specifically, when the printing with borders is specified and the size of the rendering area is determined in step S1105, the image of the printing target is magnified or reduced so as to be inscribed in the rendering area and to be entirely included therein. On the other hand, when the borderless printing is specified and the size of the rendering area is determined in step S1110, the image of the printing target is magnified or reduced so as to be circumscribed to the rendering area and to include the rendering area therein.

As another example of the magnification/reduction processing in step S1111, a width and a length of an image of the printing target can be separately magnified or reduced so that the width and the length of the image of the printing target can fit into the rendering area.

As described above, according to the processing shown in FIG. 7, if there is a plurality of candidates of the sheet size and it is not determined that the borderless printing is executed (NO in both of step S1100 and step S1101), the processing proceeds to step S1102 and step S1103. Then, in step S1102 and step S1103, the minimum sheet width and the minimum sheet length in the plurality of candidates are set as the size of the rendering area. In step S1105, the image of the printing target is magnified or reduced according to the size of the rendering area obtained by subtracting the margin respectively from the minimum sheet width and the minimum the sheet length. Therefore, even the print sheet to be used in the printing apparatus 100 is any of the plurality of candidates, an image of the printing target of which width and length are shorter than the sheet width and the sheet length of the print sheet is generated, so that the entire image of the printing target can be printed on the print sheet.

Further, according to the processing shown in FIG. 7, if there is a plurality of candidates of the sheet size and it is determined that the borderless printing is executed (YES in step S1100, and NO in step S1106), the processing proceeds to step S1107 and step S1108. Then, in step S1107 and step S1108, the maximum sheet width and the maximum sheet length in the plurality of candidates are set as the size of the rendering area. In step S1110, the image of the printing target is magnified or reduced according to the size of the rendering area obtained by further enlarging the maximum sheet width and the maximum the sheet length by the enlargement rate for the borderless printing. Therefore, even the print sheet to be used in the printing apparatus 100 is any of the plurality of candidates, an image of the printing target of which width and length are longer than the sheet width and the sheet length of the print sheet is generated, so that the printing can be performed without including the margins in the print sheet.

Further, according to the present exemplary embodiment, the fitting printing is executed when the type of the data of the printing target or the type of the apparatus which transmitted the data is a specific type. Therefore, by setting the specific type to the one corresponding to photographic data, for example, the data can be prevented from being printed by the fitting processing on a print sheet different in size from a page size when the page size is set in a document file.

In step S1105 or step S1110, whether to enlarge or reduce an image of the printing target and an enlargement rate or a reduction rate at that time are determined according to an original size of the image of the printing target and the rendering area in the print sheet, and changing the magnification of the image is performed according to the determined enlargement rate or reduction rate.

Further, the image of the printing target which is magnified or reduced in step S1105 or step S1110 is input from the print job received in step S1001 in FIG. 5. However, if an address indicating a location of the printing target is included in the print job, an image of the printing target is input from the apparatus like a server or the memory corresponding to the address. In addition, an image of the printing target is not limited to an image in a bitmap format and can be vector data. In this case, a vector image is magnified or reduced on the image memory 206 in step S1111, and then converted into bitmap data.

In the examples illustrated in FIGS. 6A and 6B, and FIG. 7, when a plurality of candidates of the sheet size is specified by the detection result of the sheet sensor 118, a sheet width and a sheet length are determined by taking all sheet widths and sheet lengths of the plurality of candidates into consideration. However, the present exemplary embodiment is not limited to these example. For example, if sheet sizes subjected to the borderless printing are limited, the sheet sizes to be referred from the plurality of candidates may be narrowed down when the borderless printing is set. For example, when a side-opening envelope No. 6, a postcard, and a "4*6" size are specified as candidates of the sheet size, and only the "4*6" size is subjected to the borderless printing, the "4*6" size can be determined as the print sheet size to be used in the printing. For this determination processing, information indicating, for example, whether each sheet size corresponds to the borderless printing is included in the sheet size tables in FIGS. 4A and 4B. Then, when the borderless printing is executed, the CPU 201 can execute narrowing-down processing as described above by referring to the sheet size table.

According to the above exemplary embodiment, an example is described in which the printing apparatus 100 determines a sheet size of a print sheet when receiving a print job from the external apparatus and executes printing according to the determined sheet size. However, the exemplary embodiment is not limited to the example. The sheet size can be determined by a copy function of printing a scanned image read by the scanner 220 provided to the printing apparatus 100 to a print sheet.

Figure 8:
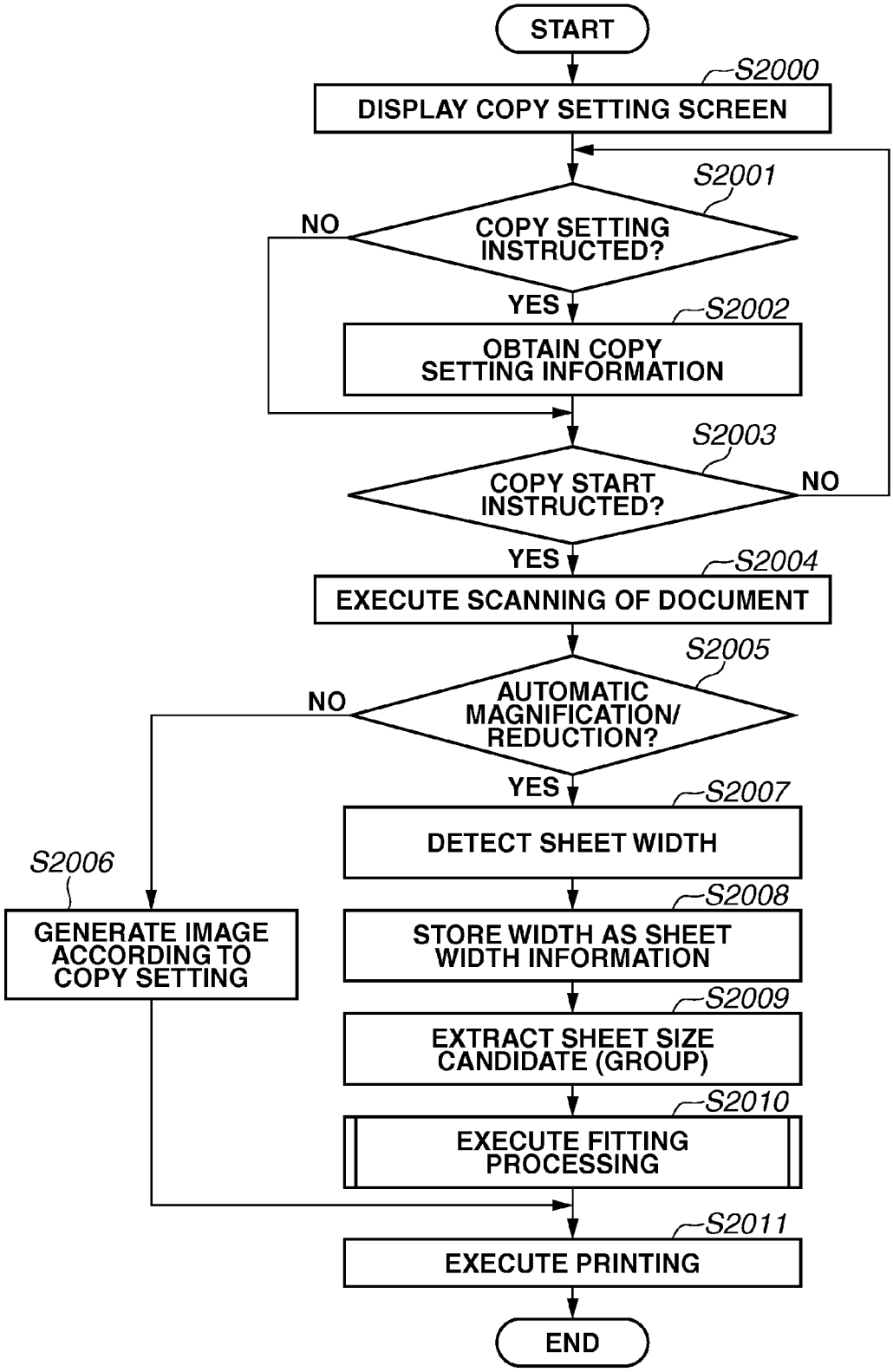
FIG. 8 is a flowchart illustrating an example of print control processing of a copy function.

FIG. 8 is a flowchart illustrating an example of print control processing by the copy function. Processing in the flowchart illustrated in FIG. 8 is executed by the CPU 201 similar to the processing illustrated in FIG. 5. Further, the processing in the flowchart illustrated in FIG. 8 is executed when a user selects the copy function using the operation panel 218 of the printing apparatus 100 and an instruction to execute the copy function is input to the CPU 201.

In step S2000, the CPU 201 causes the panel control unit 217 to display a copy setting screen for allowing a user to specify a copy setting in the copy function and a start of copying on the display panel of the operation panel 218. Contents to be set on the copy setting screen include settings of a sheet size of a print sheet to be used in the copy function, the number of prints, the margin setting, print density, and the like. The margin setting includes a specification of "borderless copying" indicating whether to provide margins (borders) in a print sheet and a setting of a width of the margin when the borderless copying is not specified. Copy setting information indicating initial settings of the copy setting is stored in the program memory 203, and the CPU 201 reads out the copy setting information to the data memory 204 and display the initial settings on the copy setting screen. A user can instruct the copy setting by changing the default settings.

The above-described copy setting includes a magnification setting relating a magnification (enlargement or reduction) of a scanned image read by the scanner 220, and for example, when "direct print setting" is specified, the scanned image is printed without changing the magnification. When the magnification is specified by a user, a scanned image is magnified or reduced by the specified magnification. Further, when "automatic magnification/reduction" is specified, magnification change (fitting processing) is executed so that a scanned image is fit into a size of a sheet stored in the printing apparatus 100.

In step S2001, the CPU 201 determines whether a user inputs an instruction of the copy setting to the operation panel 218. If it is determined that the copy setting is instructed (YES in step S2001), the processing proceeds to step S2002, whereas if it is determined that the copy setting is not instructed (NO in step S2001), the processing proceeds to step S2003.

In step S2002, the CPU 201 obtains the copy setting information indicating the copy setting that the user instructed to the operation panel 218 via the panel control unit 217. In step S2002, the CPU 201 rewrites the copy setting information stored in the data memory 204 to the copy setting information specified by the user. In step S2003, the CPU 201 determines whether a user instructs a start of copying. If it is determined that the start of copying is instructed (YES in step S2003), the processing proceeds to step S2004, whereas if it is not determined that the start of copying is instructed (NO in step S2003), the processing returns to step S2001. In step S2004, the CPU 201 causes the scanner control unit 219 to read a document by the scanner 220.

Next, in step S2005, the CPU 201 determines whether the "automatic magnification/reduction" is specified in the copy setting information stored in the data memory 204. In step S2005, if the "automatic magnification/reduction" is determined not to be specified (NO in step S2005), then in step S2006, the CPU 201 generates an image of the printing target on the image memory 206 according to the magnification setting in the copy setting information.

On the other hand, in step S2005, if the "automatic magnification/reduction" is determined to be specified (YES in step S2005), the processing in step S2007 to step S2010 is executed. In step S2007 to step S2010, the print sheet size being conveyed in the printing apparatus 100 is determined, and the scanned image obtained by the reading in step S2004 is magnified or reduced according to the determined sheet size. The processing in step S2007 to step S2010 is similar to the processing in step S1003 to step S1006 described above with reference to FIG. 5, thus the detail descriptions thereof are omitted.

In step S2011, the CPU 201 outputs the image of the printing target generated on the image memory 206 in step S2006 or step S2010 to the head control unit 213. Then, the CPU 201 drives the print head 112 and the carriage 113 to print the image of the printing target on the print medium.

As described above, according to the processing shown in FIG. 8, when the magnification setting in the copy setting information is the "automatic magnification/reduction", an image can be printed in a size according to the size of the sheet which is determined based on the detection by the sheet sensor 118 and is conveyed in the printing apparatus 100.

In addition, when the borderless copying is set as the margin setting in the copy setting information obtained in step S2002 and the plurality of candidates of the sheet size is specified in step S2008, the fitting processing according to the margin setting is executed in step S2010. More specifically, as illustrated in FIG. 6B, the maximum sheet width and the maximum sheet length in the plurality of candidates are determined as the image size of the printing target, and the scanned image is magnified or reduced according to the determined size.

The fitting processing is performed as described above, so that if, for example, a user specifies borderless copying and a plurality sheet sizes is specified as candidates, copying can be executed without including margins in the print sheet.

As described above, according to the present exemplary embodiment, when the plurality of candidates is specified as the print sheet size to be used in printing, the print sheet size is determined according to the margin setting when the printing id executed. Then, the image size of the printing target is determined according to the print sheet size and the margin setting.

For example, when the "borderless printing" is set as the margin setting, the sheet size is determined by a sheet width of a sheet having the maximum sheet width in the plurality of candidates and a sheet length of a sheet having the maximum sheet length in the plurality of candidates. Then, the image of the printing target is magnified so as to be larger than the print sheet size.

The image of the printing target is magnified as thus described, so that even the print sheet to be used in printing is any of the plurality of candidates, the image larger than the print sheet can be printed. Therefore, a print result can be prevented from including a margin.

According to the above exemplary embodiment, when the plurality of candidates is specified as the print sheet size to be used in printing, first the sheet width and the sheet length are determined, and then the image size of the printing target is determined by reflecting the margin setting to the sheet width and the sheet length. However, not limited to the above, for example, a table indicating an image size of a printing target determined from a plurality of candidates and a margin setting is stored in the program memory 203, and the image size of the printing target may be determined by referring to the table.

Further, according to the above exemplary embodiment, the sheet size is determined according to whether the borderless printing is set as the margin setting. However, it is not limited to this, and a value of a margin can be obtained as the margin setting. For example, a user inputs a value of a margin width on the operation panel 218, and the sheet size may be determined according to the input value of the margin width. More specifically, if a sheet width is equal to or less than a predetermined width, the maximum sheet width and the maximum sheet length may be selected from the plurality of candidates. Further, for example, if only a margin width on a sheet width is equal to or less than the predetermined width and a sheet length is larger than the predetermined width, the maximum sheet width and the minimum sheet length may be selected from the plurality of candidates.

According to the above exemplary embodiment, an example is described in which an image of the printing target obtained by reception of a print job or the like is magnified or reduced according to a size of a print medium determined based on the margin setting in printing. However, not limited to the example, an image can be generated in size corresponding to the size of the print medium when the printing apparatus 100 newly generates an image of the printing target.

Further, according to the above exemplary embodiment, a candidate of the print sheet size is specified in step S1005 by the sheet width detected by the sheet sensor 118, which is obtained in step S1003 in FIG. 5. Then, if there is a plurality of candidates, the fitting processing (determination of the print sheet size by the specification of borderless printing or printing with borders) is executed in step S1006.

However, not limited to the above, in step S1005, the narrowing-down processing of candidates may be performed when there is the plurality of candidates of the print sheet size, and the processing in step S1006 (the processing in FIG. 7) may be executed if a plurality of candidates is still remained as the result of narrowing-down.

Conditions for narrowing down the candidates in the above narrowing-down processing may include, for example, a type of a print sheet (a postcard, an envelope, or the like) to be used in printing, and information indicating a destination of the printing apparatus 100. In other words, when the sheet type set in the print setting is a specific type, such as a "postcard" and an "envelope", candidates of which print sheet size correspond to the "postcard" and the "envelope" can be specified from among the plurality of candidates. Further, a sheet size frequently used in the destination of the printing apparatus 100 can be specified as the print sheet size in the relevant printing from among the plurality of candidates. Furthermore, a plurality of conditions can be used in combination for the above-described narrowing-down processing.

According to the above exemplary embodiment, an example is described in which a print sheet size is determined based on a detection result of the sheet sensor 118 when the printing apparatus 100 performs printing based on a print job received from the external apparatus or when the copy function is executed in the printing apparatus 100. However, the exemplary embodiment is not limited to the example. For example, the above-described determination processing of the print sheet size can be executed when a user prints an image stored in the memory card 223 inserted in the memory card slot 222 according to the print setting set via the operation panel 218. For example, when the sheet size is not specified in the print setting information indicating the print setting specified by the user, the above-described determination processing may be executed. Examples of the case that the sheet size is not specified in the print setting information may be a case where the sheet size is not included in the print setting information, and a case where an instruction to execute processing for setting the print sheet size using the sheet sensor 118 is included in the print setting information.

When printing is performed in the printing apparatus 100 according to the print setting specified by the user as thus described, an image stored in an internal memory of the printing apparatus 100 can be printed in addition to the external memory like the memory card 223. Further, an image stored in the external apparatus, such as a server, connected to the printing apparatus 100 via a network can also be printed according to the print setting specified by the user via the operation panel 218 of the printing apparatus 100.

According to the above exemplary embodiment, an example is described in which the sheet sensor 118 of the printing apparatus 100 detects a sheet width. In addition to the example, the sensor may detect a sheet length or both of a width and a length of a sheet. In any of these detection methods, when there is a plurality of candidates for the print sheet size used in the printing apparatus 100, an appropriate sheet size can be determined by the processing in the above-described exemplary embodiment.

Further, not limited to the case that the sheet size is automatically determined by the sensor, for example, a user can specify, on the operation panel, a size of a sheet stored in a cassette of the printing apparatus or a size of a sheet inserted into a sheet feeding port of the printing apparatus by the user. Then, the size specified by the user is applied to the sheet size automatically determined by the sensor according to the above exemplary embodiment, and the processing in the above exemplary embodiment may be executed.

As described above, a user can specify the sheet size at an arbitrary timing. For example, the printing apparatus is provided with a sensor for detecting opening and closing of a cassette of the printing apparatus or a sensor for detecting whether a sheet exists on a sheet feeding port. When the sensor detects opening and closing of the cassette, or detects that a sheet is inserted to the sheet feeding port, a screen for enabling a user to specify a size or a type of the sheet is displayed on the operation panel the printing apparatus. Then, the size specified by the user on the screen can be used as the size determined by the sensor in the above exemplary embodiment.

Further, according to the above exemplary embodiment, an example is described in which the CPU 201 provided to the printing apparatus 100 executes the determination processing of the sheet size illustrated in FIG. 6 as an information processing apparatus. However, not limited to the example, an information processing apparatus, such as a host computer or a server, which is connected to the printing apparatus 100 and causes the printing apparatus to execute printing can operate as a print control apparatus according to the present exemplary embodiment and execute the processing in the present exemplary embodiment.

More specifically, when transmitting a print job to the printing apparatus 100, the host computer, the server, or the smart device executes the processing in step S1001 to step S1007 in FIG. 5. In other words, when any of these apparatuses transmits a print job to the printing apparatus 100, the apparatus obtains sheet width information of the print sheet detected by the sheet sensor 118 of the printing apparatus 100. Then, a candidate of the print sheet size is specified according to the sheet width indicated by the obtained information, and a layout area is determined based on the specified candidate and the set sheet size. Further, an image of the printing target is rendered with respect to the layout area on the memory included in the host computer, the server, or the smart device, and the rendered image is transmitted to the printing apparatus 100 as a print job to cause the printing apparatus 100 to execute printing. More specifically, the printing mechanism in the printing apparatus 100 prints the image received from the host computer, the server, or the smart device on a print sheet according to the control by the CPU 201 of the printing apparatus 100.

As another example that the host computer, the server, or the smart device performs the processing according to the present exemplary embodiment, the processing up to the determination of the size of the layout area in step S1100 to step S1110 in FIG. 7 can be performed by these apparatuses. In this case, changing the magnification of an image of the printing target in step S1111 is executed by the CPU 201 in the printing apparatus 100. Regarding sharing of the processing between the printing apparatus 100 and the apparatus, such as the host computer, the server, and the smart device, various configurations can be applied to the present exemplary embodiment.

According to the above exemplary embodiment, a print sheet is described as an example of a print medium on which an image is printed by the printing apparatus. However, in addition to that, an overhead projector (OHP) sheet can be used as the print medium. In addition to a rectangular print medium like the above-described print sheet, a disk-shaped recording medium, such as a compact disc (CD) and a digital versatile disc (DVD), can also be used.

Other Embodiments

Embodiments can also be realized by a computer of a system or apparatus that reads out and executes computer executable instructions recorded on a storage medium (e.g., computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

A computer executable instructions for realizing a function of the present exemplary embodiment may be executed by a single computer (a CPU or a MPU) or may be executed by the cooperation of a plurality of computers. Further, the computer executable instructions may be executed by a computer, and hardware, such as a circuit, for realizing the function of the computer executable instructions may be provided. Furthermore, a part of the computer executable instructions may be realized by the hardware and the rest may be executed by the computer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and function.

This application claims the benefit of Japanese Patent Application No. 2013-137040, filed Jun. 28, 2013, which is hereby incorporated by reference herein in its entirety.

What is claimed is:

1. An apparatus comprising:

a first determination unit configured to determine a margin setting for printing of an image of a printing target;

a detection unit configured to detect a size of a print medium;

a specification unit configured to specify a plurality of candidates of the print medium corresponding to a detection result by the detection unit;

a second determination unit configured to determine at least one of a width and a length corresponding to the margin setting determined by the first determination unit based on at least one among the plurality of candidates specified by the specification unit; and a print control unit configured to cause a print unit to print the image of the printing target in a size corresponding to at least one of the width and the length determined by the second determination unit.

2. The apparatus according to claim 1, wherein the first determination unit determines whether to provide a print medium with a margin in printing of the image of the printing target as a margin setting.

3. The apparatus according to claim 2, wherein, in a case where the margin setting determined by the first determination unit is a setting for providing a print medium with no margin, the second determination unit determines a width based on a candidate having a maximum width and a length based on a candidate having a maximum length from among the plurality of candidates.

4. The apparatus according to claim 2, wherein, in a case where the margin setting determined by the first determination unit is a setting for providing a print medium with a margin, the second determination unit determines a width based on a candidate having a minimum width and a length based on a candidate having a minimum length from among the plurality of candidates.

5. The apparatus according to claim 1, wherein, in a case where there is only one candidate of the size of the print medium corresponding to the detection result by the detection unit, the print control unit causes the print unit to print an image in a size corresponding to the one candidate.

6. The apparatus according to claim 1, wherein the print control unit magnifies or reduces the image of the printing target according to at least one of the width and the length determined by the second determination unit and the margin setting, and causes the print unit to print the magnified or reduced image.

7. The apparatus according to claim 1, further comprising:

a third determination unit configured to determine whether to print an image in a size corresponding to at least one of width and length determined by the second determination unit according to a predetermined condition, wherein, in a case where the third determination unit determines to print the image in the size corresponding to at least one of width and length determined by the second determination unit, the print control unit causes the print unit to print the image in the size corresponding to at least one of width and length determined by the second determination unit, and in a case where the third determination unit does not determine to print an image in a size corresponding to at least one of width and length determined by the second determination unit, the print control unit causes the print unit to print an image in a size corresponding to a size of a print medium set as a print setting.

8. The apparatus according to claim 7, wherein the predetermined condition corresponds to whether a type of data corresponding to the image of the printing target is a predetermined type among a plurality of types of data which can be printed by the print unit.

9. The apparatus according to claim 8, wherein the predetermined condition additionally corresponds to whether a format of a file including the data is a predetermined file format.

10. The apparatus according to claim 9, wherein the predetermined file format is a joint photographic experts group (JPEG) format.

11. The apparatus according to claim 7, further comprising:

a reception unit configured to receive data corresponding to the image of the printing target from an external apparatus, wherein the predetermined condition additionally corresponds to whether a protocol used when the reception unit receives the data from the external apparatus is a predetermined protocol.

12. The apparatus according to claim 1, wherein the print unit conveys a print medium to a position corresponding to a print head and executes printing by the print head with respect to the conveyed print medium, and wherein the detection unit is provided on a position corresponding to the print head and detects a size of a print medium when the print medium is conveyed thereto.

13. The apparatus according to claim 1, wherein the detection unit detects a width of a print medium.

14. The apparatus according to claim 1, wherein the first determination unit determines a margin setting set according to an instruction of a user.

15. The apparatus according to claim 1, wherein the print control unit configured to cause a print unit to print the image of the printing target in a size corresponding to at least one of the width and the length determined by the second determination unit and the margin setting.

16. The apparatus according to claim 1, wherein, the second determination unit determines a width based on a first candidate and a length based on a second candidate from among the plurality of candidates.

17. A method comprising:

determining a margin setting for printing of an image of a printing target;

detecting a size of a print medium;

specifying a plurality of candidates of the print medium corresponding to a result of the detecting;

determining at least one of a width and a length corresponding to the determined margin setting based on at least one among the specified plurality of candidates; and causing a print unit to print the image of the printing target in a size corresponding to the at least one of determined width and length and the margin setting.

18. A non-transitory computer-readable storage medium storing computer executable instructions for causing a computer to execute a method, the method comprising:

determining a margin setting for printing of an image of a printing target;

detecting a size of a print medium;

specifying a plurality of candidates of the print medium corresponding to a result of the detecting;

determining at least one of a width and a length corresponding to the determined margin setting based on at least one among the specified plurality of candidates; and causing a print unit to print the image of the printing target in a size corresponding to the at least one of determined width and length and the margin setting.

* * * * *